US005785554A

United States Patent [19]

Ohshiro

[11] Patent Number: 5,785,554

[45] Date of Patent: Jul. 28, 1998

[54] COAXIAL CONNECTOR

[76] Inventor: Yoshio Ohshiro, c/o Niko Denki Kogyo Co. Ltd. 1-40-13 Nishigaoka, Kita-ku, Tokyo 115, Japan

[21] Appl. No.: 626,456

[22] Filed: Apr. 2, 1996

[51] Int. Cl.[6] ..... H01R 17/04

[52] U.S. Cl. ..... 439/584; 439/583

[58] Field of Search ..... 439/578, 580, 439/583, 584, 585

[56] References Cited

U.S. PATENT DOCUMENTS

| | | | |
|---|---|---|---|
| 2,986,720 | 5/1961 | Chess | 439/583 |
| 3,184,706 | 5/1965 | Atkins | 439/584 |
| 3,634,815 | 1/1972 | Stevens | 439/583 |
| 3,854,789 | 12/1974 | Kaplan | 439/584 |
| 4,249,790 | 2/1981 | Ito et al. | 439/583 |
| 4,397,516 | 8/1983 | Koven et al. | 439/584 |
| 4,854,893 | 8/1989 | Morris | 439/583 |
| 5,340,332 | 8/1994 | Nakajima et al. | 439/583 |
| 5,352,134 | 10/1994 | Jacobsen et al. | 439/583 |

*Primary Examiner*—J. J. Swann

*Attorney, Agent, or Firm*—Hedman, Gibson & Costigan, P.C.

[57] ABSTRACT

A coaxial connector is constructed from a shell which is either adapted to be freely connected to and disconnected from a connection portion of a transmitting device or integrally formed with the connection portion of a transmitting device, a fastening member which can be screwed together with the shell to connect the fastening member to the shell; and a set of water-tight clamping components which are housed inside the fastening member, the water-tight clamping components being adapted to apply pressure to an outer casing, an outer conductor and an inner conductor of a terminal treated coaxial cable to connect the coaxial cable to the coaxial connector when the fastening member is screwed together with the shell.

4 Claims, 8 Drawing Sheets

FIG. 4(b)
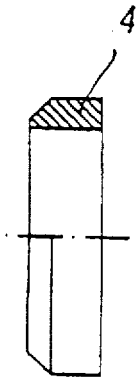
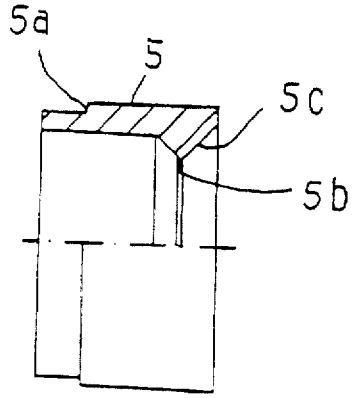
FIG. 4(a)
FIG. 4(c)
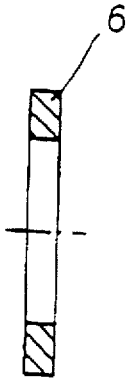
FIG. 4(d)
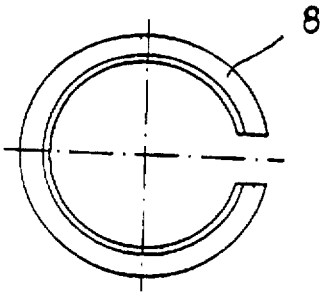

FIG. 4(f)
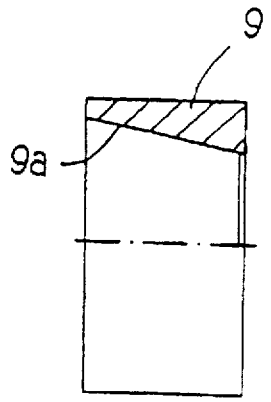
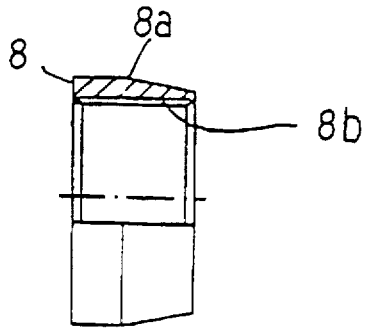
FIG. 4(e)
FIG. 4(g)
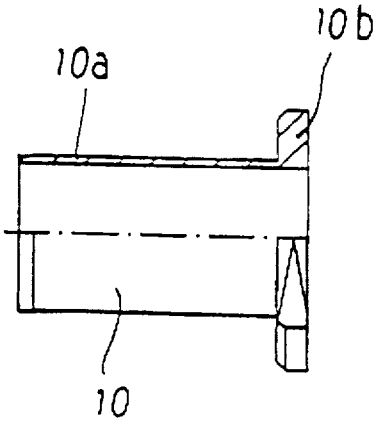
FIG. 4(h)
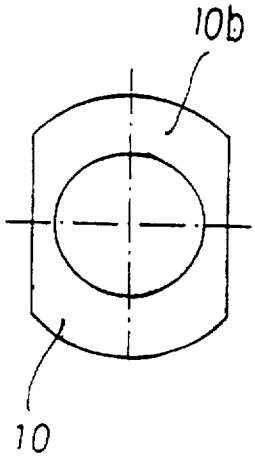

COAXIAL CONNECTOR

BACKGROUND OF THE INVENTION

1. Field of the Invention

The present invention relates to a coaxial connector for forming connections with coaxial cables, and in particular relates to a coaxial connector for forming connections between coaxial cables and transmitting devices such amplifiers, branches and distributors of satellite broadcast reception systems, and various outside equipment for receiving common television transmissions.

2. Description of the Prior Art

One type of coaxial connector known in the prior art is an FT-type connector disclosed in a previous application by the present inventor and now made public (Japanese Laid-Open Patent Application HEI 7-105256).

The construction of such FT-type connector is as follows. Namely, a central contact is provided such that one portion of a pin portion thereof protrudes to the outside of a connector body, with the base portion of the pin body being supported by a single insulating body housed inside the connector body and a guide body receiving portion of the central contact being constricted by a sliding insulating body which is housed inside the connector body so as to be freely slidable therein. Further, a reinforcing sleeve having a tube portion and a flange formed at a base portion of the tube portion is provided such that one end thereof protrudes to the outside of the connector body, with the flange being housed inside the contact body so as to abut a step portion inside the connector body, and wherein the flange is covered by the sliding insulating body. Further, a first clamp having one end portion which abuts the flange and another end portion which is stopped by the end portion of the connector body is provided inside the connector body, and a tapered clamp which has a tapered portion that makes sliding contact with the first clamp is provided at a position inside a fastening member which connects to the connector body such that one portion of the tapered clamp protrudes outside the connector body, with a split portion being formed in the tapered clamp in axial direction along the entire body thereof at one location and partial split portions being formed in the tapered clamp in the axial direction at locations that face the tube portion. Further, undulating portions are formed in the inner circumferential surfaces of the tapered clamp and the tube portion of the reinforcing sleeve for compressing the outer conductor of the coaxial cable, and an outer-conductor-use gasket for applying pressure to the outer conductor of the coaxial cable is provided in the end portion of the tapered clamp. Further, a second clamp is provided inside the fasten member, with one end portion of the second clamp making contact with the outer-conductor-use gasket and housing a lubrication-use support ring which makes contact with an end surface of the tapered clamp, and with the other end of the second clamp housing a lubrication-use washer. Further, an outer-casing-use gasket which makes contact with the lubrication-use washer is housed inside the fastening member to apply pressure to the outer casing of the coaxial cable.

However, when such a coaxial connector is used to form connections between a coaxial cable and transmitting device such as an amplifier, branch or distributor of a satellite broadcast reception system or other various outside equipment for receiving common television transmissions, the connector body must be separated into two or three units. As a result, when the connector is to be attached to the transmitter, the terminal treated coaxial cable must first be inserted into the fastening member in order to connect the coaxial cable to the coaxial connector, and after the inner conductor of the coaxial cable has been inserted into the conductor receiving portion of the central contact, the fastening member is screwed together with the connector body to complete the connection of the coaxial cable with the transmitter, but this requires the carrying out of two or three screw connections.

Furthermore, after the coaxial cable has been mounted inside the coaxial connector, the fastening member must be removed from the connector body in order to remove the coaxial cable from the coaxial connector.

Consequently, when mounting and removing operations are carried out with this type of prior art coaxial connector, such operations must be carried out for the two or three connector bodies that form the structure of the coaxial connector, and this places a great burden on the person who must carry out such operations. Furthermore, in addition to increased costs, there is an increase in the number of parts needed for the coaxial connector, and this in turn increases the likelihood that parts will be lost during connection-forming operations.

Furthermore, in the case where coaxial cables having different thicknesses are to be used, the fastening member, the shell, the components housed within the coaxial connector and the connection portion of the transmitter must all be changed in accordance with the thickness of the coaxial cable.

SUMMARY OF THE INVENTION

In order to overcome the problems of the prior art mentioned above, it is an object of the present invention to provide a coaxial connector which has only one fastening member for connecting a coaxial cable to the coaxial connector, wherein the set of all components for connecting the coaxial cable to the coaxial connector are held inside the fastening member to make it easy for such set of components to be housed in or removed from the coaxial connector. It is another object of the present invention to provide a coaxial connector in which the shell, which is adapted to be connected to the coaxial connector and a connection portion of a transmitter, does not need to be changed even when coaxial cables of different thicknesses are to be connected to the coaxial connector.

In order to achieve the above-stated objects, the coaxial connector according to one embodiment of the present invention comprises a shell which can be freely connected to and disconnected from a connection portion of a transmitter and which is provided with a ring-shaped abutment wall formed on an inside portion thereof, a fastening member which is adapted to be connected to the shell, and a set of water-tight clamping components provided inside the fastening member. With this arrangement, when the fastening member is screwed together with the shell, such screwing operation causes the outer casing, outer conductor and inner conductor of a terminal treated coaxial cable to be fixed in place by the resulting pressure applied by the water-tight clamping components.

In another embodiment of the present invention, the coaxial cable comprises a shell which is integrally formed with a connection portion of a transmitter and which is provided with a ring-shaped abutment wall formed on an inside portion thereof, a fastening member which is adapted to be connected to the shell, and a set of water-tight clamping components provided inside the fastening member. In the same manner as was described above for the first embodiment, when the fastening member is screwed together with the shell of this embodiment, such screwing operation causes the outer casing, outer conductor and inner conductor of a terminal treated coaxial cable to be fixed in place by the resulting pressure applied by the water-tight clamping components.

In other words, the shell of the coaxial connector according to the present invention can be formed either as a separate element which is adapted to be connected to the connection portion of a transmitter or as an integral part which protrudes from the connection portion of the transmitter.

As for the water-tight clamping components which are provided inside the fastening member, they are comprised of the following elements:

- a gasket which is arranged at one end portion inside the fastening member for applying pressure to the outer casing of the coaxial cable;
- a first collar having one end which abuts the gasket and another end which abuts a washer, the first collar being equipped with a step portion formed on the outside circumferential surface thereof for abutment with a ring-shaped protrusion formed in the fastening member and a constriction opening which allows the outer conductor of the terminal treated coaxial cable to pass therethrough;
- a pressure ring such as an O-ring, gasket or the like arranged between the washer and a tapered portion formed inside the front end portion of the first collar, the pressure ring being adapted to apply pressure to the outer conductor of the terminal treated coaxial cable to form a water-tight seal;
- a split clamp arranged so that one end thereof abuts the washer, with the other end portion thereof having a tapered portion formed on the outer circumferential surface thereof to make slidable contact with a tapered clamp, the split clamp further including an inner surface which is adapted to apply strong pressure to the outer conductor of the terminal treated coaxial cable;
- a tapered clamp which is arranged inside the fastening member so as to be movable in the axial direction thereof, the tapered clamp including an inner circumferential surface tapered portion which makes sliding contact with the split clamp;
- a flange-equipped sleeve which faces the split clamp and which is adapted to fit inside and support the outer conductor of the terminal treated coaxial cable, the flange-equipped sleeve including a flange which abuts the front end surface of the tapered clamp;
- a backup ring which is made from an electrically insulating synthetic resin and which includes two leg portions which abut the front end surface of the the tapered clamp and between which the flange of the flange-equipped sleeve is inserted, the backup ring further including a constriction opening adapted to allow only the inner conductor of the terminal treated coaxial cable to be inserted therethrough and a constricting tapered portion which holds a conductor receiving portion of a central contact, whereby the inner conductor of the coaxial cable is held in an inserted state by the receiving portion;
- a second collar which houses the backup ring in a manner that allows the backup ring to be slidable in the axial direction, the second collar including a ring-shaped step portion formed in the inner circumferential surface of a rear end portion thereof such that when the flange of the flange-equipped sleeve is inserted into the second collar, the flange abuts the step portion and is held thereby in a fixed state, the second collar further including a ring-shaped groove which makes it possible to prevent the second collar from being pulled out of the fastening member while at the same time allowing the second collar to be slidable in the axial direction thereof; and
- a circular shaped insulating body 14 which is tightly inserted into the front end portion of the second collar, the central contact being fixedly held in the center portion of the insulating body so as to extend in the axial direction.

With the above-described construction, when the fastening member and the water-tight clamping components housed therein for holding the outer casing, outer conductor and inner conductor of a terminal treated coaxial cable are changed in accordance with the thickness of the coaxial cable to be connected, there is no need to change the shell which is to be connected to the fastening member. In other words, the shell which is connected to the connection portion of a transmitter does not need to be changed even when different fastening members need to be used to connect coaxial cables having different thicknesses.

BRIEF DESCRIPTION OF THE DRAWINGS

FIG. 4(*b*) is a half transverse sectional view of a first collar; FIG. 4(*c*) is a cross-sectional view of a washer; FIG. 4(*d*) is a side view of a split clamp; FIG. 4(*e*) is a half transverse sectional view of a split clamp; FIG. 4(*f*) is a half transverse sectional view of a tapered clamp; FIG. 4(*g*) is a half transverse sectional view of a flange-equipped sleeve; FIG. 4(*h*) is a side view of a flange-equipped sleeve; FIG. 4(*i*) is a side view of a backup ring; FIG. 4(*j*) is a half transverse sectional view of a backup ring; FIG. 4(*k*) is a half transverse side view of a central contact; FIG. 4(*l*) is a half transverse sectional view of a central contact; FIG. 4(*m*) is a side view of an insulating body; FIG. 4(*n*) is a half transverse side view of an insulating body; FIG. 4(*o*) is a half transverse side view of a second collar; and FIG. 4(*p*) is a half transverse sectional view of a ring bearing.

DETAILED DESCRIPTION OF THE PREFERRED EMBODIMENTS

With reference to the drawings, a detailed description of the preferred embodiments will now be given below.

Figure 1:
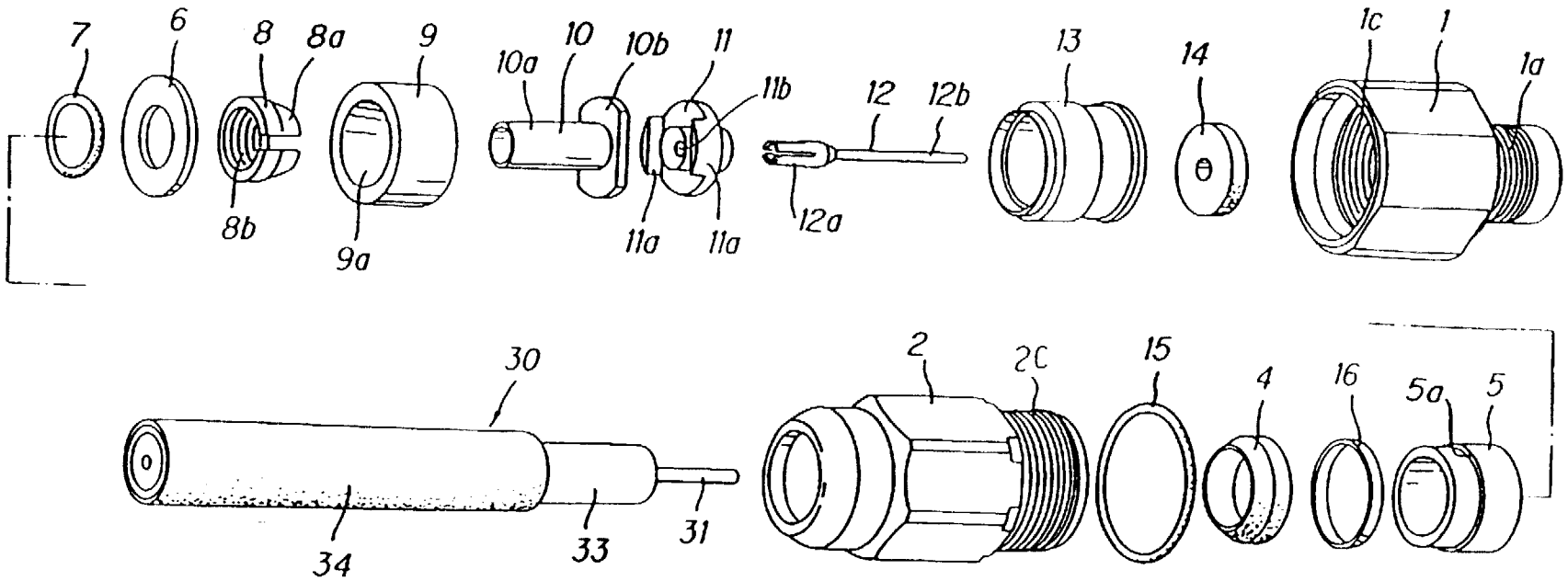
FIG. 1 is an exploded perspective view of a coaxial connector according to the present invention.
Figure 2:
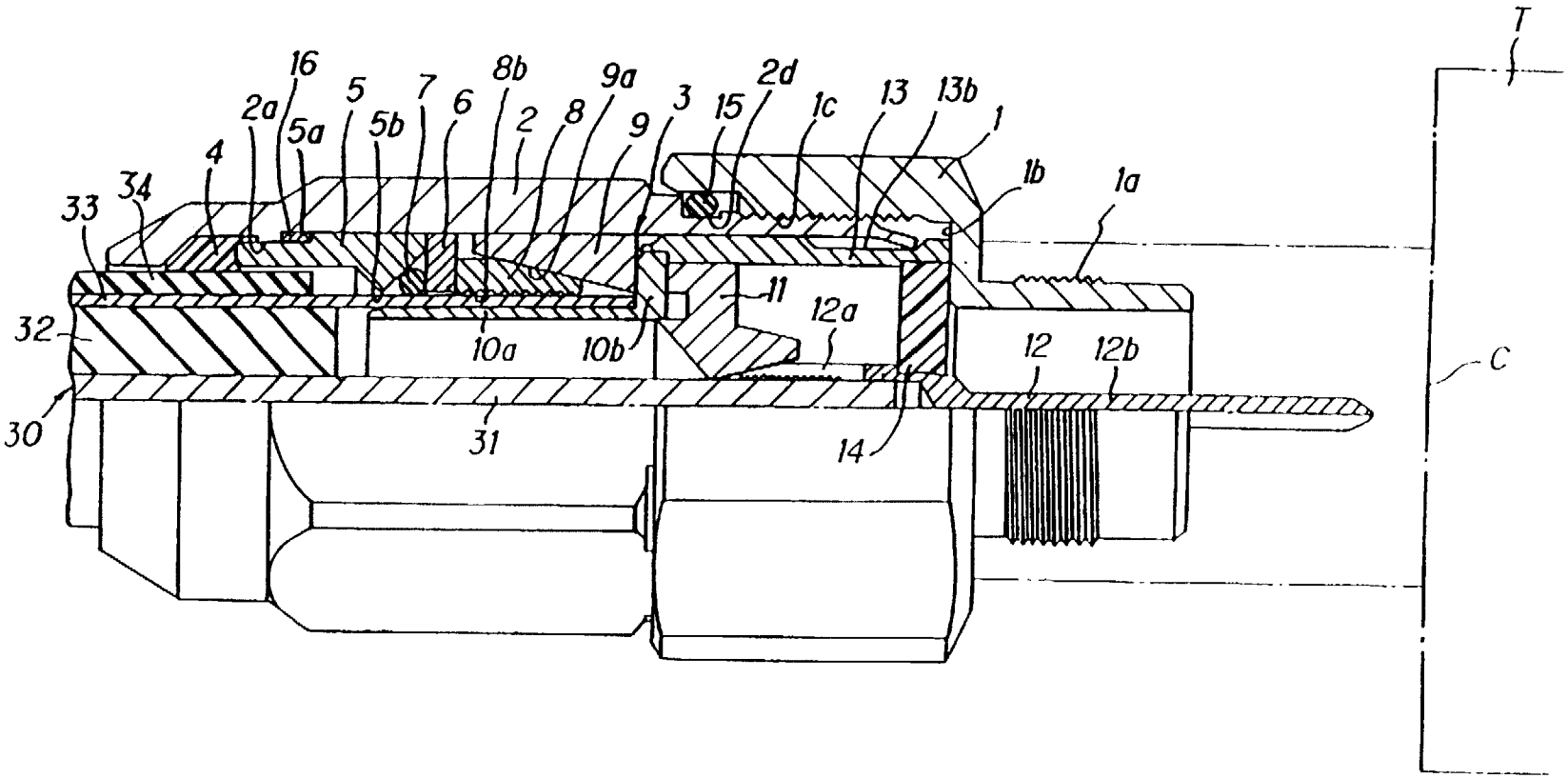
FIG. 2 is a cross-sectional view of the coaxial cable shown in FIG. 1.
Figure 3:
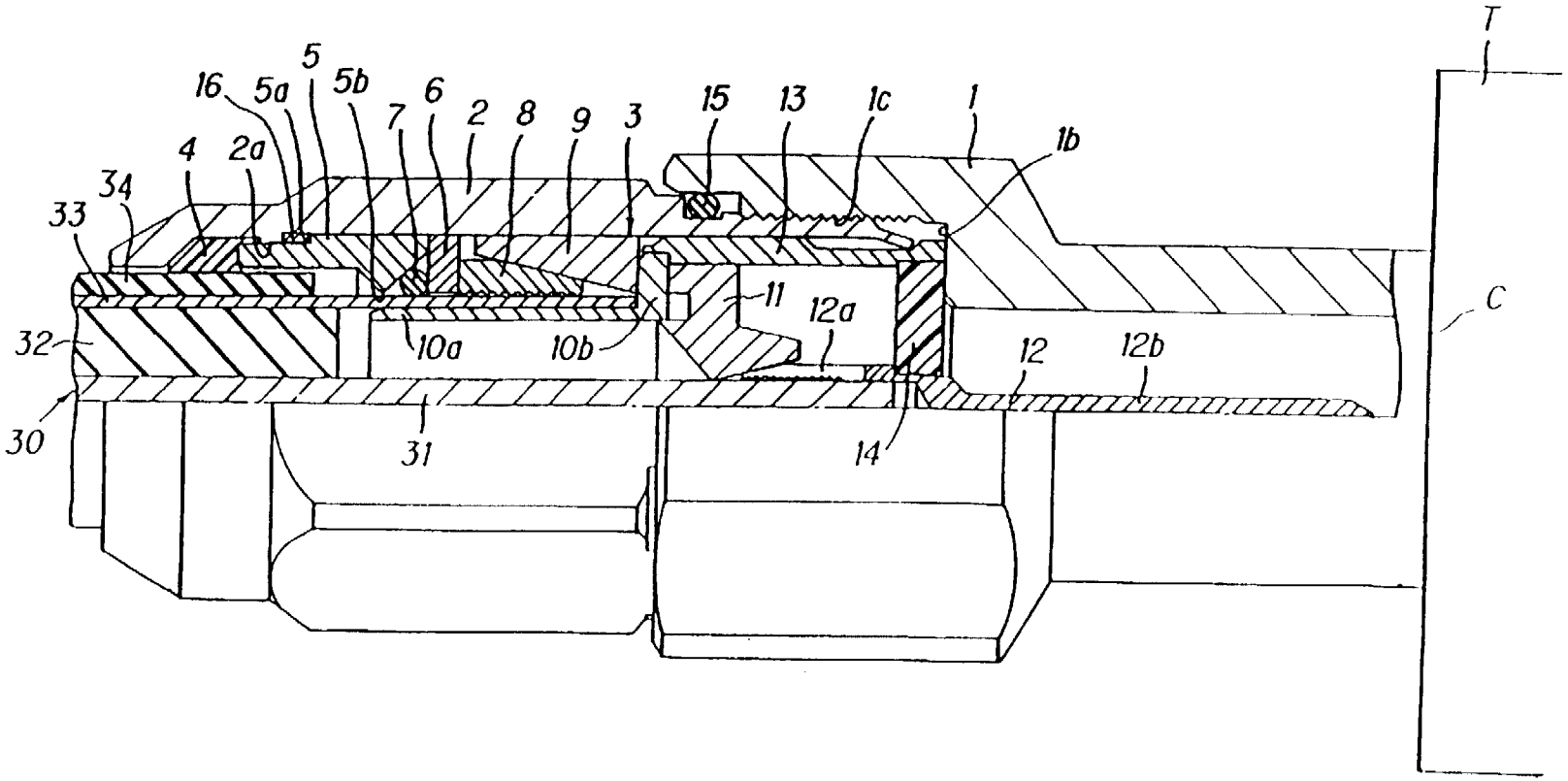
FIG. 3 is a cross-sectional view of another embodiment of a coaxial connector according to the present invention.
Figure 4I:
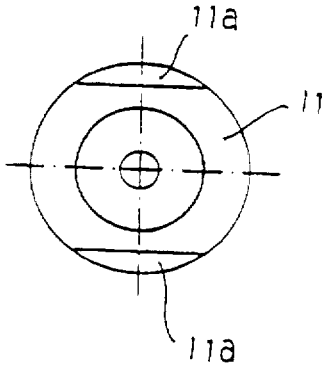
FIGS. 4(*a*)–(*p*) are drawings which show each component of a set of water-tight clamping components which are housed inside a fastening member according to the present invention. Namely, FIG. 4(*a*) is a half transverse sectional view of a gasket.
Figure 4J:
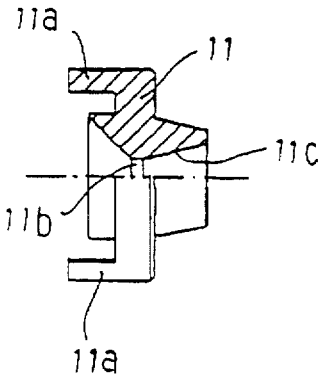
Figure 4K:
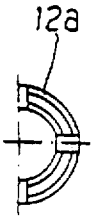
Figure 4L:
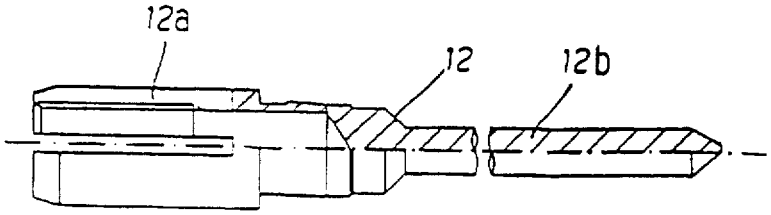
Figure 4M:
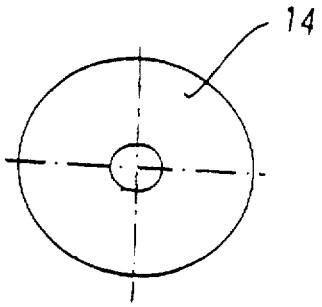
Figure 4N:
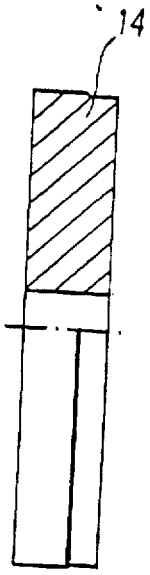
Figure 4O:
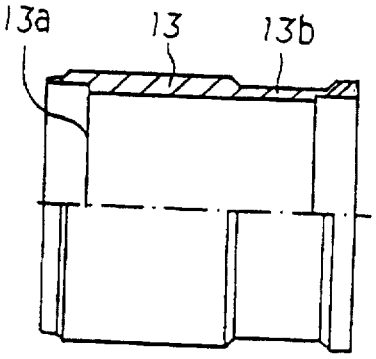
Figure 4P:
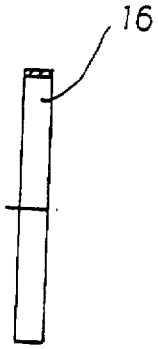
Figure 5A:
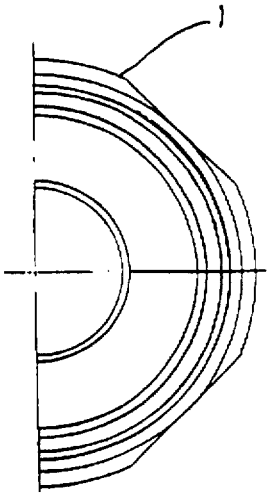
FIG. 5(*a*) is a half transverse side view of a shell, and FIG. 5(*b*) is a half transverse sectional view of a shell.
Figure 5B:
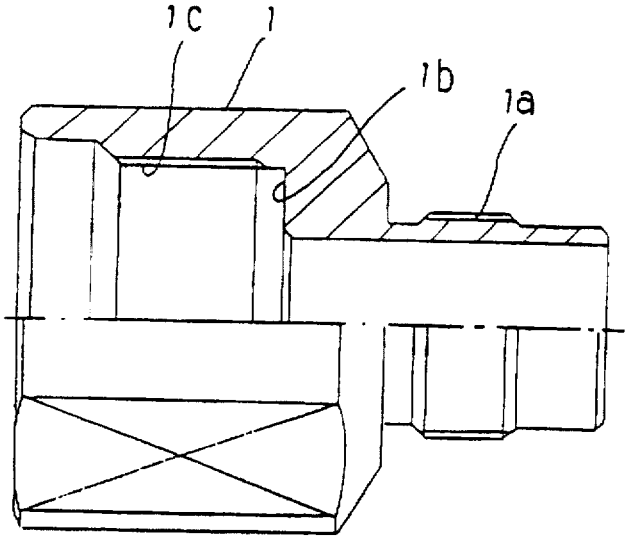

As shown in FIGS. 1 and 2, the coaxial connector according to the present invention is constructed from a shell 1, which can be freely connected to and disconnected from a connection portion "C" of a transmitter "T" of an amplifier, a branch or distributor of a satellite broadcast reception system, or outside equipment for receiving common television transmissions. Alternately, as shown in FIG. 3, the shell 1 can be integrally formed with the connection portion C of the transmitter T. Further, a wall portion is provided at an inside portion of the shell 1 to hold an end portion of a fastening member 2 (described hereinbelow) in a fixed position. Now, in order to avoid having to change the shell 1 when coaxial cables of different thicknesses are being used, in the present invention it is only necessary to change the fastening member 2 and its set of water-tight clamping components 3 for clamping in place an outer casing 34, an outer conductor 33 and inner conductor 31 of a terminal treated coaxial cable 30. In FIGS. 2 and 3, 32 is an insulator.

In the present embodiment, the shell 1 is freely connected to and disconnected from the connection portion C of the transmitter T by means of a screw arrangement. Namely, a threaded portion 1*a* is formed on the outer circumferential surface of the end portion of the shell 1 to mate with a threaded portion of the connection portion C, with a ring-shaped abutment wall 1*b* provided inside the shell 1 and a threaded portion 1*c* formed inside the shell 1 adjacent to the abutment wall 1*b* to mate with a threaded portion 2*c* formed on the outer circumferential surface of the end portion of the fastening member At this point it is to be understood that the connection means of the present invention is in no way limited to this screw arrangement, and it is possible to employ any suitable connection means, such as a push-in type connecting means which uses a stopper to hold the fastening member in place, so long as such connecting means makes it possible to freely connect and disconnect the shell 1.

Further, in order to form a water-tight seal when the threaded portion 2*c* of the fastening member 2 is screwed together with the threaded portion 1*c* of the shell 1, an O-ring 15 is provided in a ring-shaped groove 2*d* formed near the rear end portion of the threaded portion 2*c* of the fastening member 2.

Now, in the case where the shell 1 is integrally formed with the connection portion C of the transmitter T so as to form a protrusion therefrom, the threaded portion 1*a* is not formed, and only the ring-shaped abutment wall 1*b* and the threaded portion 1*c* provided adjacent to the abutment wall 1*b* are formed inside the shell 1, with the threaded portion 1*c* being adapted to mate with the threaded portion 2*c* of the fastening member 2 in the same manner as was described above.

The fastening member 2 includes a set of water-tight clamping components 3 which clamp in place the outer casing 34, the outer conductor 33 and the inner conductor 31 of the terminal treated coaxial cable 30 when the fastening member 2 and the shell 1 are screwed together.

The water-tight clamping components 3 will now be described in detail with reference to FIGS. 1–4 (4(*a*)–4(*p*)).

Namely, as shown in the drawings, a gasket 4 for applying holding pressure to the outer casing 34 of the coaxial cable 30 is loaded inside one end of the fastening member 2. Loaded next into the inside of the fastening member 2 is a first collar 5 having one end which abuts the gasket 4 and another end which abuts a washer 6. Further, mounted onto the outer circumferential surface of a rear end portion of the first collar 5 is a ring bearing 16 which abuts a step portion 5*a* formed on the outer circumferential surface of such rear end portion, whereby the ring bearing 16 abuts a ring-shaped protrusion 2*a* formed inside the fastening member 2 when the collar 5 is loaded into the fastening member 2. In this way, when the fastening member 2 and the shell 1 are screwed together, the action of the ring bearing 16 prevents the coaxial cable 30 from rotating together with the fastening member 2, and this makes it possible to easily connect the fastening member 2 and the shell 1. Namely, by preventing the coaxial cable 30 from twisting when the fastening-member 2 is being screwed into the shell 1, it becomes much easier to connect the fastening member 2 to the shell 1. Further, the first collar 5 forms an inner diameter that allows the outer casing 34 of the terminal treated coaxial cable 30 to be inserted therein, but has a constriction opening 5*b* at the front end portion thereof that prevents the outer casing 34 from passing therethrough while allowing the outer conductor 33 to pass therethrough.

Further, a pressure ring 7 comprised of an O-ring, gasket or the like is provided between the washer 6 and a tapered portion 5*c* formed on an inner circumferential surface of the first collar 5. When the outer conductor 33 of the terminal treated coaxial cable 30 is held by pressure, the pressure ring 7 serves as a water sealing means to prevent water from entering from the outside of the fastening member.

Further, a split clamp 8 is provided so that one end thereof abuts the washer 6, with the other end portion of the split clamp 8 having a tapered portion 8*a* formed on the outer circumferential surface thereof to make slidable contact with a tapered clamp 9. The split clamp 8 is split in the axial direction of the coaxial cable to enable the inner surface thereof to apply a high degree of pressure to the outer conductor 33 of the terminal treated coaxial cable 30, and an undulating portion 8*b* may be formed in the inner surface of the split clamp 8 to strengthen the holding grip of the split clamp on the outer conductor 33.

As for the tapered clamp 9, it is loaded inside the fastening member 2 so as to be movable in the axial direction thereof and includes a tapered portion 9*a* which forms an inner circumferential surface that makes slidable contact with the split clamp 8.

Next in the sequence of components is a flange-equipped sleeve 10 which has a tube-shaped sleeve 10*a* which faces the split clamp 8 and fits inside and supports the outer conductor 33 of the terminal treated coaxial cable 30, and which has a flange 10*b* formed at the front portion of the sleeve 10*a*. In this arrangement, the rear end surface of the flange 10*b* abuts the front end surface of the tapered clamp 9.

Further provided in the sequence of components is a backup ring 11 which is made from an electrically insulating synthetic resin and which includes two leg portions 11*a* which abut the front end surface of the the tapered clamp 9 and between which the flange 10*b* of the flange-equipped sleeve 10 is inserted. Further, the backup ring 11 is formed with a constriction opening 11*b* that allows only the inner conductor 31 of the terminal treated coaxial cable 30 to be inserted therethrough and a constricting tapered portion 11*c* which holds a conductor receiving portion 12*a* of a central contact 12, which is comprised of the conductor receiving portion 12*a* and a pin portion 12*b*, whereby the inner conductor 31 of the coaxial cable 30 is held in an inserted state by the receiving portion 12*a*.

Next in the sequence of components is a second collar 13 which houses the backup ring 11 in a manner that allows the backup ring 11 to be slidable in the axial direction. The second collar 13 has a ring-shaped step portion 13*a* formed in the inner circumferential surface of a rear end portion thereof, and when the flange 10*b* of the flange-equipped sleeve 10 is inserted into the second collar 13, the flange 10*b* abuts the step portion 13*a* and is held thereby in a fixed state. Further, a circular shaped insulating body 14 is tightly inserted into the front end portion of the second collar 13, with the central contact 12 being fixedly held in the center portion of the insulating body 14 so as to extend in the axial direction. Further, a ring-shaped groove 13*b* is formed in the outer circumferential surface of the front end portion of the second collar 13 to enable the second collar 13 to be movable in the axial direction along the inner surface of the fastening member 2, and when the second collar 13 is housed inside the fastening member 2, the front end of the fastening member 2 is positioned at an outside portion of the ring-shaped groove 13*b* so as to act as a stopper to prevent the second collar from being pulled out of the fastening member 2.

Next, a method of using the coaxial connector according to the present embodiment will be given below.

First, the threaded portion 1*a* of the shell 1 is screwed into the connection portion C of the transmitter T. Alternately, a protruding shell 1 which is integrally formed with the connection portion C of the transmitter T is used. Next, the end portion of a coaxial cable 30 undergoes a prescribed dimensional terminal treatment. Then the inner conductor 31 of the terminal treated coaxial cable 30 is passed into the fastening member 2 and inserted into the conductor receiving portion 12*a* of the central contact 12. Now, as shown in FIG. 1, at the time the inner conductor 31 of the coaxial cable 30 is inserted into the conductor receiving portion 12*a* of the central contact 12, the outer conductor 33 of the coaxial cable 30 becomes sandwiched between the sleeve 10*a* of the flange-equipped sleeve 10 and the split clamp 8 and passes into the fastening member 2 up to the point where the tip portion of the outer conductor 33 abuts the rear end portion of the flange 10*b*. In this state, the pin portion 12*b* of the central contact 12 housed inside the fastening member 2 is connected to the connecting portion C of the transmitter T.

Now, when the threaded portion 2*c* of the fastening member 2 is screwed into the threaded portion 1*c* of the shell 1, the front end surface of the second collar 13 abuts the ring-shaped abutment wall 1*b* of the shell 1, and the two leg portions 11*a* of the backup ring 11 which extend from the rear end portion of the second collar 13 abut the front end surface of the tapered clamp 9. Upon being pushed by the tapered clamp 9, the backup ring moves forward in the axial direction, and this causes the tapered portion 9*a* to constrict the conductor receiving portion 12*a* of the central contact 12, whereby the undulating portion inside the conductor receiving portion 12*a* is forced to tightly grip the inner conductor 31 of the coaxial cable 30 to fix the inner conductor 31 in place. Further, the rear end surface of the flange 10*b* of the flange-equipped sleeve 10 held in place inside the rear end portion of the second collar 13 is forced to abut the front end surface of the tapered clamp 9, and this causes the split clamp 8 to constrict due to the sliding contact between the tapered portions 8*a*, 9*a*, whereby the undulating portion 8*b* of the split clamp 8 is caused to tightly grip the outer conductor 33 of the coaxial cable 30 to fix the outer conductor 33 in place.

At the same time, the pressure placed on the pressure ring 7 arranged between the first collar 5 and the washer 6 causes the pressure ring 7 to form a water-tight seal to prevent water from the outside from reaching the outer conductor 33 positioned inside the fastening member 2.

Furthermore, water is also prevented from entering into the inside of the coaxial connector by the pressure applied to the outer casing 34 of the coaxial cable 30 by the gasket 4 provided inside the fastening member 2 at the rear portion thereof. In this way, water-tight seals can be formed when the fastening member 2 is used to connect the coaxial cable 30 to the connection portion C of the transmitter T.

Now, to disconnect the coaxial cable 30 from the connection portion C of the transmitter T, the fastening member 2 is simply unscrewed from the shell 1.

As described above, the coaxial connector according to the present invention has a single fastening member which houses all elements for connecting a coaxial cable to the coaxial connector. Accordingly, the the coaxial cable can easily be connected to and disconnected from the coaxial connector.

Furthermore, even when coaxial cables having different thicknesses are used, the coaxial connector can be used without having to change the shell which is connected to the coaxial connector and the connection portion of the transmitter.

Moreover, when the fastening member is screwed to the shell, the front end surface of the second collar abuts the ring-shaped abutment wall in the inside of the shell, thereby fixing the set of water-tight clamping components in one direction. At the same time, the first collar which is housed in the rear portion of the fastening member abuts a ring-shaped protrusion inside the fastening member to fix the water-tight clamping components in the other direction. In this way, with the water-tight clamping components fixed in both directions at such points, it becomes possible to easily and reliably create a strong holding force with each of the water-tight clamping components to fix the outer casing, outer conductor and inner conductor of the coaxial cable.

What is claimed is:

1. A coaxial connector, comprising: a shell including an inside portion which is integrally formed with a connection portion of a transmitting device, said shell being provided with a ring-shaped abutment wall formed at said inside portion of said shell;

a fastening member which can be screwed together with said shell to connect said fastening member to said shell, and a set of water-tight clamping components which are housed inside said fastening member, said water-tight clamping components being adapted to apply pressure to an outer casing, an outer conductor, and an inner conductor of a terminal treated coaxial cable to connect said coaxial connector when said fastening member is screwed together with said shell; and said set of water-tight clamping components having an end surface with a central conductor at the center of said end surface, and said set of water-tight clamping components abuts said ring shaped abutment wall of said shell, and different portions of said set of water-tight clamping components tightly grip said inner conductor, said outer conductor and said outer casing of said coaxial cable to hold in place said inner conductor, said outer conductor and said outer casing; and said set of water-tight clamping components includes a gasket which is arranged at one end portion inside said fastening member for applying pressure to said outer casing of said coaxial cable;

a first collar having one end which abuts said gasket and another which abuts a washer, said first collar being equipped with a step portion formed on the outer circumferential surface of said first collar for abutment with a ring-shaped protrusion formed in said fastening member, and a constriction opening which allows said outer conductor of said terminal treated coaxial cable to pass therethrough;

a pressure-ring arranged between said washer and a tapered portion formed on an inner circumferential surface of said first collar, when said outer conductor of said terminal treated coaxial cable is held by pressure, said pressure ring serves as a water sealing means to prevent water from entering from the outside of said fastening member;

a split clamp is provided so that one end of said split clamp abuts said washer, with the other end portion of said split clamp having a tapered portion formed on said outer circumferential surface of said split clamp to make slidable contact with a tapered clamp, said split clamp is split in said axial direction of said coaxial cable to enable the inner surface of said split clamp to apply a high degree of pressure to said outer conductor of said terminal treated coaxial cable;

a tapered clamp which is arranged inside said fastening member so as to be movable in the axial direction of said coaxial cable, said tapered clamp including an inner circumferential surface tapered portion which makes sliding contact with said split clamp;

a flange-equipped sleeve which faces said split clamp and which is adapted to fit inside and support said outer conductor of said terminal treated coaxial cable, said flange-equipped sleeve including a flange portion which abuts an end surface of said tapered clamp;

a backup ring which is made from an electrically insulating synthetic resin and which includes two leg portions which abut said end surface of said tapered clamp and between which said flange portion said flange-equipped sleeve is inserted, said backup-ring further including a constriction opening adapted to allow only said inner conductor of said terminal treated coaxial cable to be inserted therethrough and a constricting tapered portion which holds a conductor receiving portion of a central contact, whereby said inner conductor of said said coaxial cable is held in an inserted state by said conductor receiving portion; and a second collar which houses said backup ring in a manner that allows said backup ring to be slidable in the axial direction of said coaxial cable, said second collar fixing said flange portion of said flange-equipped sleeve at an end portion of said second collar, said second collar fixing an insulating body which centrally supports said central contact, said insulating body being fixed at an end portion of the second collar, and said second collar being slidable in said axial direction of said coaxial cable inside said fastening member and provided with a stopper means to prevent said second collar from being pulled out of said fastening member.

2. The coaxial connector of claim 1, wherein said fastening member is provided with a threaded portion, and wherein the dimensions of said fastening member and said set of water-tight clamping components can be changed in accordance with the thickness of said coaxial cable without having to change the dimensions of said threaded portion, whereby coaxial cables having different thicknesses can be connected to said coaxial connector without the need to change the dimensions of the shell.

3. A coaxial connector comprising:

a shell including an inside portion which can be freely connected and disconnected from a connection portion of a transmitting device, said shell being provided with a ring-shaped abutment wall formed at said inside portion of said shell;

a fastening member which can be screwed together with said shell;

a set of water-tight clamping components, which are housed inside said fastening member, said water-tight clamping components being adapted to apply pressure to an outer casing, an outer conductor, and an inner conductor of a terminal treated coaxial cable to connect said coaxial cable to said coaxial connector when said fastening member is screwed into said shell; and said set of water-tight clamping components having an end surface with a central conductor at the center of said end surface, and said set of water-tight clamping components abuts said ring shaped abutment wall of said shell, and different portions of said set of water-tight clamping components tightly grip said inner conductor, said outer conductor and said outer casing of said coaxial cable to hold in place said inner conductor, said outer conductor and said outer casing; and said set of water-tight clamping components includes a gasket which is arranged at one end portion inside said fastening member for applying pressure to said outer casing of said coaxial cable;

a first collar having one end which abuts said gasket and another which abuts a washer, said first collar being equipped with a step portion formed on the outer circumferential surface of said first collar for abutment with a ring-shaped protrusion formed in said fastening member, and a constriction opening which allows said outer conductor of said terminal treated coaxial cable to pass therethrough;

a pressure ring arranged between said washer and a tapered portion formed on an inner circumferential surface of said first collar, when said outer conductor of said terminal treated cable is held by pressure, said pressure ring serves as a sealing means to prevent water from entering from the outside of said fastening member;

a split clamp is provided so that one end of said split clamp abuts said washer, with the other end portion of said split clamp having a tapered portion formed on said outer circumferential surface of said split clamp to make slidable contact with a tapered clamp, said split clamp is split in said axial direction of said coaxial cable to enable the inner surface of said split clamp to apply a high degree of pressure to said outer conductor of said terminal treated coaxial cable;

a tapered clamp which is arranged inside said fastening member so as to be movable in the axial direction of said coaxial cable, said tapered clamp including an inner circumferential surface tapered portion which makes sliding contact with said tapered clamp, including an inner circumferential surface tapered portion which makes sliding contact with said split clamp;

a flange-equipped sleeve which faces said split clamp and which is adapted to fit inside and support said outer conductor and said terminal treated coaxial cable, said flange-equipped sleeve including a flange portion which abuts an end surface of said tapered clamp;

a backup ring which is made from an electrically insulating synthetic resin and which includes two leg portions which abut said end surface of said tapered clamp and between which said flange portion said flange equipped sleeve is inserted, said backup ring further including a constriction opening adapted to allow only said inner conductor of said terminal treated coaxial cable to be inserted therethrough and a constricting tapered portion which holds a conductor receiving portion of a central contact, whereby said inner conductor of said coaxial cable is held in an inserted state by said conductor receiving portion; and a second collar which houses said backup ring in a manner that allows said backup ring to be slidable in an axial direction of said coaxial cable, said second collar fixing said flange portion of said flange-equipped sleeve at an end portion of said second collar, said second collar fixing an insulating body which centrally supports said central contact, said insulating body being fixed at an end portion of the second collar, and said second collar being slidable in said axial direction of said coaxial cable inside said fastening member and provided with a stopper means to prevent said second collar from being pulled out of said fastening member.

4. The coaxial connector of claim 3, wherein said fastening member is provided with a threaded portion, and wherein the dimensions of said fastening member and said set of water-tight clamping components can be changed in accordance with the thickness of said coaxial cable without having to change the dimensions of said threaded portion, whereby coaxial cables having different thicknesses can be connected to said coaxial connector without the need to change the dimensions of the shell.

* * * * *